US012263514B2

(12) United States Patent
Kondo et al.

(10) Patent No.: US 12,263,514 B2
(45) Date of Patent: Apr. 1, 2025

(54) PRESS FORMING METHOD

(71) Applicant: JFE STEEL CORPORATION, Tokyo (JP)

(72) Inventors: Osamu Kondo, Tokyo (JP); Akinobu Ishiwatari, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 461 days.

(21) Appl. No.: 17/605,085

(22) PCT Filed: Jan. 20, 2020

(86) PCT No.: PCT/JP2020/001651
§ 371 (c)(1),
(2) Date: Oct. 20, 2021

(87) PCT Pub. No.: WO2020/230367
PCT Pub. Date: Nov. 19, 2020

(65) Prior Publication Data

US 2022/0193747 A1 Jun. 23, 2022

(30) Foreign Application Priority Data

May 13, 2019 (JP) ..... 2019-090549

(51) Int. Cl.
*B21D 22/26* (2006.01)
*B21D 5/01* (2006.01)
*B21D 53/88* (2006.01)

(52) U.S. Cl.
CPC ..... *B21D 22/26* (2013.01); *B21D 53/88* (2013.01); *B21D 5/01* (2013.01)

(58) Field of Classification Search
CPC ..... B21D 22/20; B21D 22/22; B21D 22/26; B21D 22/30; B21D 47/01; B21D 53/88; B21D 5/083
See application file for complete search history.

(56) References Cited

U.S. PATENT DOCUMENTS

2011/0120204 A1* 5/2011 Maeda ..... B21D 22/02 72/309
2014/0356643 A1* 12/2014 Nakata ..... B21D 22/26 428/603

(Continued)

FOREIGN PATENT DOCUMENTS

JP 2006-289480 A 10/2006
JP 2010-23078 A 2/2010

(Continued)

OTHER PUBLICATIONS

Feb. 25, 2020 International Search Report issued in International Patent Application No. PCT/JP2020/001651.

*Primary Examiner* — Christopher L Templeton
*Assistant Examiner* — P Derek Pressley
(74) *Attorney, Agent, or Firm* — Oliff PLC

(57) ABSTRACT

A press forming method includes: a first forming step of press-forming a preformed part including: a top portion and flange portions having same shapes as a top portion and a flange portions in a target shape of a press-formed product; and side wall portions having projecting chevron shape in a cross-section in a press-forming direction as compared with side wall portions; and a second forming step of press-forming the preformed part into the target shape. Each side wall portions includes: a side wall portion adjacent to top connecting to the top portion; a side wall portion adjacent to flange connecting to the flange; and a bent portion between the side wall portion adjacent to top and the side wall portion adjacent to flange. An angle on an acute side formed by the side wall portion adjacent to top and a horizontal plane decreases toward an end portion from a center.

2 Claims, 7 Drawing Sheets

(56) References Cited

U.S. PATENT DOCUMENTS

| | | | | |
|---|---|---|---|---|
| 2018/0104733 | A1 | 4/2018 | Kubo et al. | |
| 2018/0264534 | A1 * | 9/2018 | Aso | B21D 47/01 |

FOREIGN PATENT DOCUMENTS

| | | | | | |
|---|---|---|---|---|---|
| JP | 2017196646 | A * | 11/2017 | | B21D 5/01 |
| WO | WO-2016104376 | A1 * | 6/2016 | | B21D 22/20 |
| WO | 2016/171230 | A1 | 10/2016 | | |

* cited by examiner (a) CENTER (b) END PORTION (a) CENTER (b) END PORTION (a) CENTER (b) END PORTION (a) CENTER (b) END PORTION

PRESS FORMING METHOD

FIELD

The present invention relates to a press forming method, and in particular, a press forming method of a press-formed product that has a hat-shaped cross section having a top portion, side wall portions, and flange portions and that curves along the longitudinal direction in planar view.

BACKGROUND

In automotive parts, there are many cases in which those having a closed cross-section formed by joining flange portions of press-formed products for which mainly a steel sheet is press-formed to have a hat-shaped cross section are applied. Thus, in order to join a press-formed product having a hat-shaped cross section with another part by spot welding or the like, the angle of the flange portion of the relevant press-formed product needs to be matched with respect to the joint surface (flange portion and the like) of the other part. For this reason, in the press-formed product having a hat-shaped cross section, it is important to perform press-forming by improving the accuracy of the angle of the flange portion. However, there has been a problem in that, when performed the press-forming by using a high-strength steel sheet, the angle of the flange portion is changed due to springback after press-forming as the strength increases and it is not possible to join it to the joint surface of the other part with high accuracy.

So far, some of the technologies that improve the accuracy of the angle of the flange portion of the press-formed product having a hat-shaped cross section have been disclosed. In Patent Literature 1, in press-forming of a final forming product having a hat-shaped cross section including a top portion, side walls, and flanges and curving along the longitudinal direction, a technique in which a preformed part having tapered portions expanding from the lower ends of the side walls and flange portions extending from the lower ends of the tapered portions is formed at the first step and the tapered portions and the flanges of the relevant preformed part are reformed into flat flanges at the second step is disclosed, and it is said that it is possible to suppress the springback of the flange and to improve the angle between the flange and the side wall and the flatness of the flange.

In Patent Literature 2, when forming a press-formed part having a hat-shaped cross section having a top portion, side wall portions, and flange portions into a target shape, a technique in which a preformed part having side wall portions on which a bent portion in an outwardly projecting chevron shape as compared with the target shape is formed at the first forming step and the relevant preformed part is formed into the press-formed product of the target shape in the second forming step is disclosed, and it is said that it is possible to suppress an angle change of the flange portion that is joined to other parts.

CITATION LIST

Patent Literature

Patent Literature 1: Japanese Patent Application Laid-open No. 2006-289480

Patent Literature 2: Japanese Patent Application Laid-open No. 2017-196646

SUMMARY

Technical Problem

However, according to the technique disclosed in Patent Literature 1, although the angle change between the side wall and the flange can be suppressed, there have been cases where the accuracy of the angle of the flange was reduced due to the wall curl of the side wall after press-forming.

The technique disclosed in Patent Literature 2 is intended for forming a press-formed product that is straight in the longitudinal direction, and when forming a press-formed product having a hat-shaped cross section that curves along the longitudinal direction, there has been a problem in that it is not always possible to suppress the angle change of the flange portion at both the center and the end portion side in the longitudinal direction of the relevant press-formed product.

The present invention has been made in order to solve the above-described problems, and an object of the present invention is to provide a press forming method in which, when press-forming a press-formed product having a hat-shaped cross section that curves along the longitudinal direction in planar view, the accuracy of the angle of the flange portion is improved at both the center and the end portion side in the longitudinal direction.

Solution to Problem

A press forming method according to the present invention press-forms a press-formed product having a hat-shaped cross section and including: a top portion; side wall portions continuous from the top portion; and flange portions continuous from the side wall portions, the press-forming product curving along a longitudinal direction in a planar view, the press forming method including: a first forming step of press-forming a preformed part including: a top portion and flange portions having same shapes as the top portion and the flange portions in a target shape of the press-formed product; and side wall portions having an outwardly projecting chevron shape in a cross-section in a press-forming direction as compared with the side wall portions in the target shape of the press-formed product; and a second forming step of press-forming the preformed part into the target shape, wherein each of the side wall portions in the first forming step includes: a side wall portion adjacent to top connecting to the top portion; a side wall portion adjacent to flange connecting to the flange portion; and a bent portion between the side wall portion adjacent to top and the side wall portion adjacent to flange, and an angle on an acute side formed by the side wall portion adjacent to top and a horizontal plane is set so as to decrease toward an end portion from a center in the longitudinal direction.

A press forming method according to the present invention press-forms a press-formed product having a hat-shaped cross section and including: a top portion; side wall portions continuous from the top portion; and flange portions continuous from the side wall portions, the press-forming product curving along a longitudinal direction in a planar view, the press forming method including: a first forming step of press-forming a preformed part including: a top portion and flange portions having same shapes as the top portion and the flange portions in a target shape of the press-formed product; and side wall portions having an outwardly projecting chevron shape in a cross-section in a press-forming direction as compared with the side wall portions in the target shape of the press-formed product; and a second forming step of press-forming the preformed part into the target shape, wherein each of the side wall portions in the first forming step includes: a side wall portion adjacent to top connecting to the top portion; a side wall portion adjacent to flange connecting to the flange portion; and a bent portion between the side wall portion adjacent to top and the side wall portion adjacent to flange, and a height from the top portion to the bent portion in the press-forming direction is set so as to increase toward an end portion from a center in the longitudinal direction.

Advantageous Effects of Invention

According to the present invention, the wall curl of the side wall portion due to the springback of a press-formed product that curves along the longitudinal direction in planar view can be suppressed and the angle change of the flange portion due to the wall curl can be reduced over the entire length in the longitudinal direction, so that it is possible to press-form the angle of the flange portion with high accuracy.

DESCRIPTION OF EMBODIMENTS

Prior to explaining a press forming method according to embodiments of the present invention, a press-formed product that is a forming target in the present invention will be described.

<Press-Formed Product>

Figure 2:
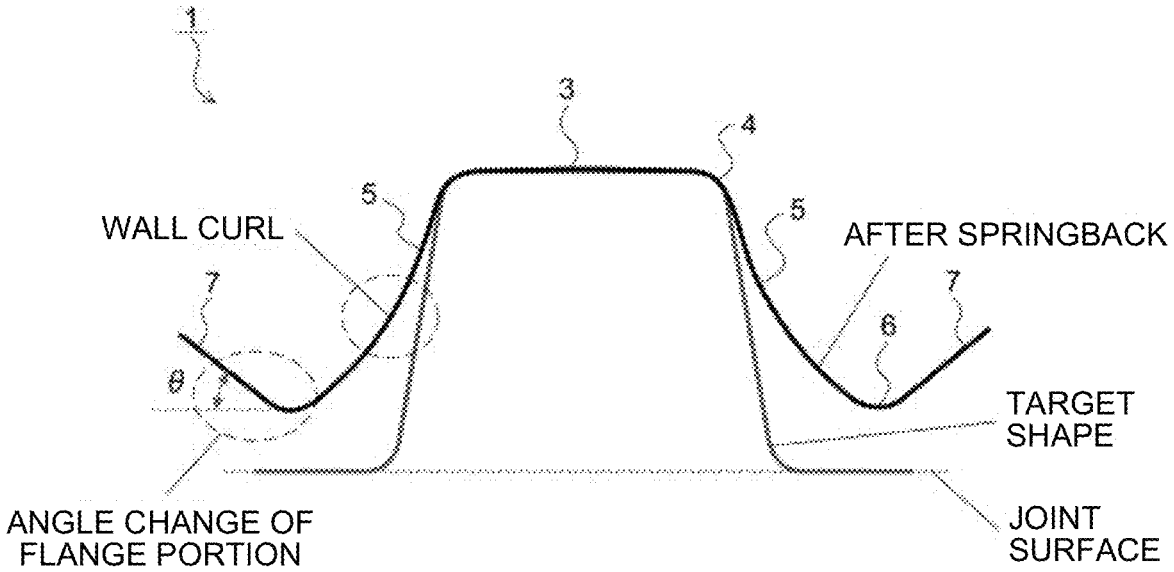
FIG. 2 is a diagram for explaining an angle change of a flange portion due to springback of the press-formed product to be a forming target in the present invention.

As illustrated in FIG. 2 as an example, a press-formed product 1 that is a forming target in the present invention has a hat-shaped cross section having a top portion 3, side wall portions 5 continuous from the top portion 3, and flange portions 7 continuous from the side wall portions 5, and curves along the longitudinal direction in planar view.

When the press-formed product 1 of such a hat-shaped cross section is die-released from a press-forming tool after press-forming, the springback of wall curl arises in the side wall portion 5 as illustrated in FIG. 2, so that the angle of the flange portion 7 may be changed with respect to the joint surface (flange portion and the like) of another part (angle change: θ) and it may be not possible to join it to the other part. Thus, in the press-formed product 1, in order to improve the accuracy of the angle of the flange portion 7, demanded is the press-forming in which the wall curl of the side wall portion 5 due to springback is suppressed.

First Embodiment

Figure 1:
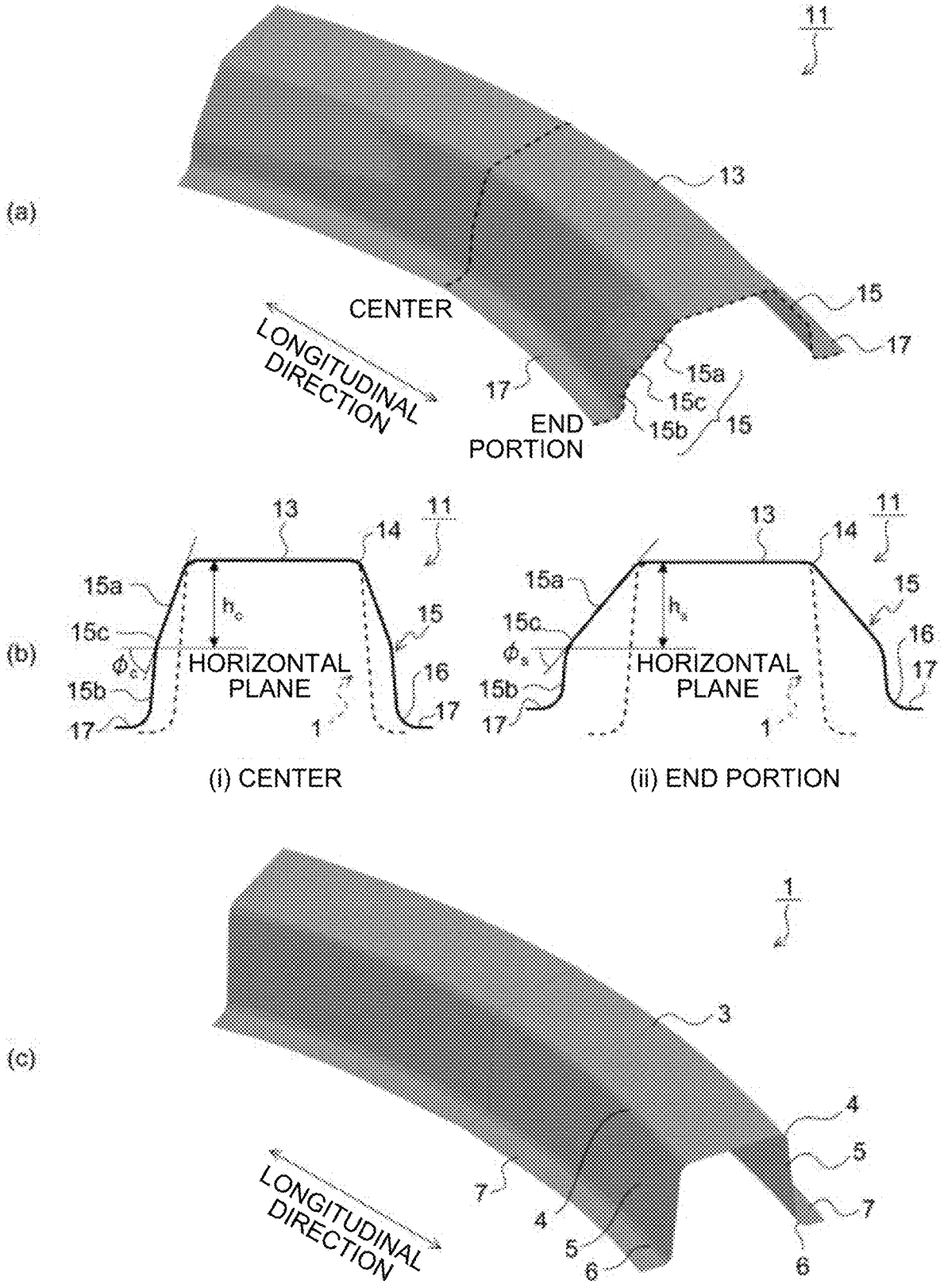
FIG. 1 is a diagram for explaining a preformed part and a press-formed product that is a target shape that are press-formed in a press forming method according to a first embodiment of the present invention ((a) is a perspective view of the preformed part, (b) is a cross-sectional view of the preformed part, (c) is a perspective view of the press-formed product).

A press forming method according to a first embodiment of the present invention is the one in which the press-formed product 1 as illustrated in FIG. 1(*c*) as an example is press-formed and that has a first forming step of press-forming a preformed part 11 as illustrated in FIG. 1(*a*) and FIG. 1(*b*) as an example and a second forming step of press-forming the preformed part 11 into the press-formed product 1 of the target shape.

<First Forming Step>

The first forming step is a step of press-forming the preformed part 11 having, as illustrated in FIG. 1(*a*) and FIG. 1(*b*), a top portion 13 and flange portions 17 of the same shape as a target shape of the press-formed product 1, and side wall portions 15 having an outwardly projecting chevron shape in a cross-section in the press-forming direction as compared with the target shape of the press-formed product 1.

Figure 3:
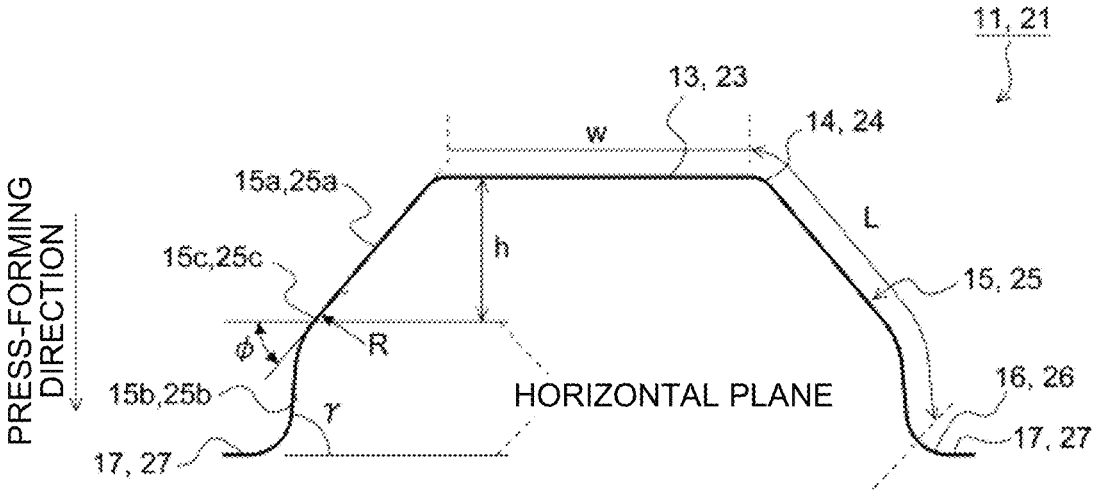
FIG. 3 is a diagram for explaining parameters that define the shape of a preformed part that is press-formed in the press forming method according to the present invention.

Each of the side wall portions 15 has a side wall portion adjacent to top 15*a* connecting to the top portion 13, a side wall portion adjacent to flange 15*b* connecting to the flange portion 17, and a bent portion 15*c* between the side wall portion adjacent to top 15*a* and the side wall portion adjacent to flange 15*b*. In this case, the shape of the side wall portion 15 is, as illustrated in FIG. 3, defined by a height h from the top portion 13 to the bent portion 15*c* in the cross-section in the press-forming direction, an angle φ on the acute side formed by the side wall portion adjacent to top 15*a* and a horizontal plane, and an angle γ formed by the side wall portion adjacent to flange 15*b* and a horizontal plane.

In the first embodiment, the preformed part 11 is set so that, as illustrated in FIG. 1(*b*), the angle φ on the acute side that is formed by the side wall portion adjacent to top 15*a* and the horizontal plane is decreased toward the end portion (angle $\varphi_s$) from the center (angle $\varphi_c$) in the longitudinal direction.

Figure 4:
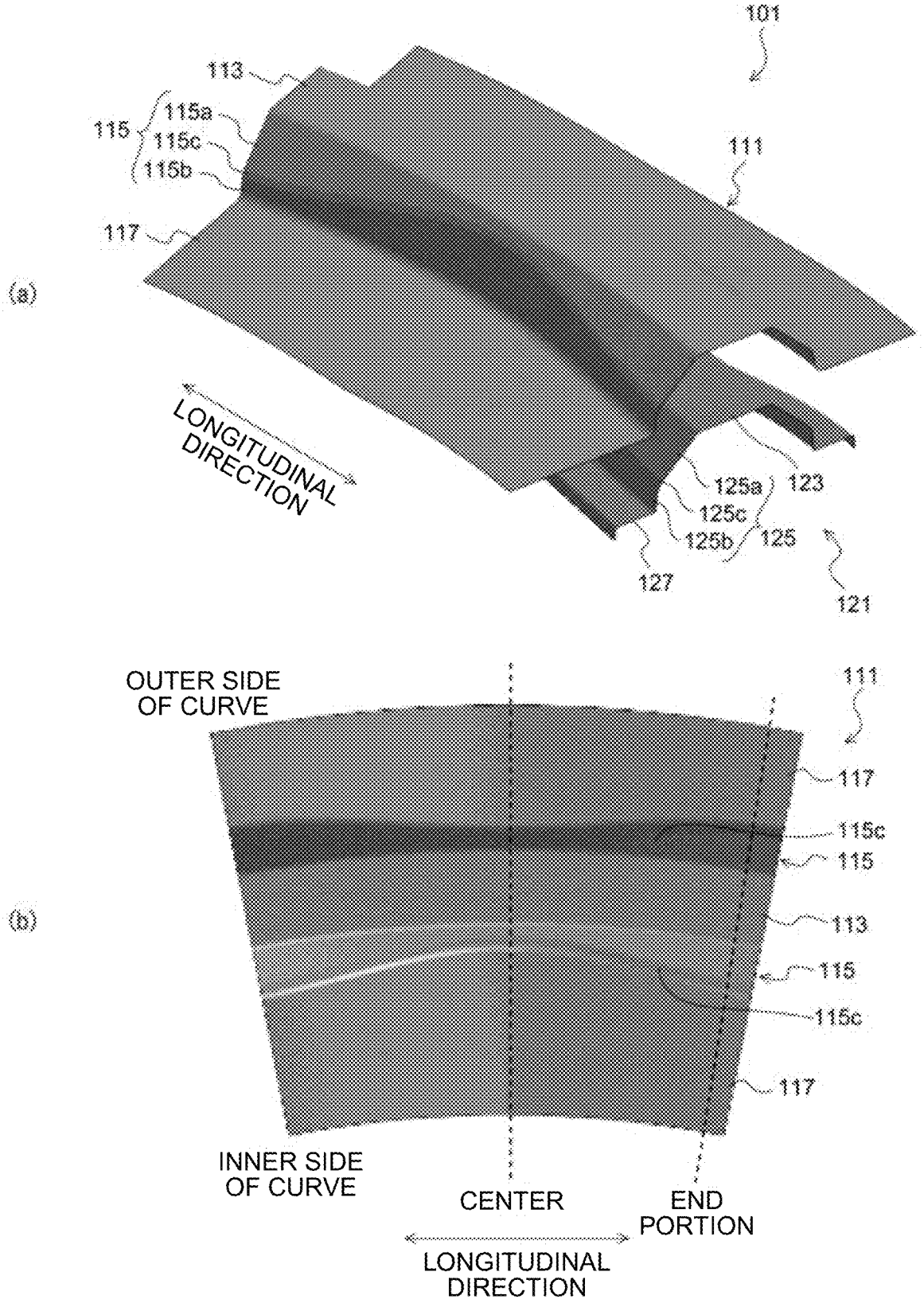
FIG. 4 is a diagram illustrating one example of a press-forming tool used at a first forming step in which the preformed part is press-formed in the press forming method according to the first embodiment of the present invention ((a) is a perspective view, (b) is a planar view of a die viewed from a punch side).

The preformed part 11 can be press-formed by using, as illustrated in FIG. 4, a press-forming tool 101 having a die 111 and a punch 121, for example. In this case, the die 111 and the punch 121 have a tool portion which forms top portion 113 and a tool portion which forms top portion 123, a tool portion which forms side wall portion 115 and a tool portion which forms side wall portion 125, and a tool portion which forms flange portion 117 and a tool portion which forms flange portion 127, respectively.

The tool portion which forms top portion 113, the tool portion which forms top portion 123, the tool portion which forms flange portion 117, and the tool portion which forms flange portion 127 are to form the top portion 3 and the flange portions 7 of the same shape as the target shape of the press-formed product 1. Meanwhile, the tool portion which forms side wall portion 115 and the tool portion which forms side wall portion 125 are to form, as compared with the target shape of the press-formed product 1, the side wall portions 15 for which the cross-section in the press-forming direction is in an outwardly projecting chevron shape.

In the preformed part 11, the side wall portions 15 are each formed on the inner side and the outer side of the curve along the longitudinal direction in planar view. Then, on both the inner side of the curve and the outer side of the curve of the side wall portions 15, the angle φ that is formed by the side wall portion adjacent to top 15*a* and the horizontal plane is set to decrease toward the end portion from the center in the longitudinal direction.

The angle γ that is formed by the side wall portion adjacent to flange 15*b* and the horizontal plane only needs to be set to the same angle as the angle that is formed by the side wall portion 5 of the press-formed product 1 of the target shape and the horizontal plane.

<Second Forming Step>

The second forming step is a step of press-forming the preformed part 11 that has been press-formed at the first forming step into the press-formed product 1 of the target shape. By the second forming step, the side wall portions 15 of the preformed part 11 are press-formed into the side wall portions 5 of the same shape as the target shape.

<Reasons of Improving Accuracy of Flange Angle by Changing Angle φ>

The reasons why it is possible to suppress the angle change (see FIG. 2) of the flange portion 7 of the press-formed product 1 due to springback by the press forming method according to the first embodiment will be described below.

As in the foregoing, the angle φ that is formed by the side wall portion adjacent to top 15*a* and the horizontal plane in the preformed part 11 is set so that, as compared with the angle $\varphi_c$ at the center in the longitudinal direction, the angle $\varphi_s$ at the end portion in the longitudinal direction is decreased (FIG. 1(*b*)). That is, in the side wall portion adjacent to top 15*a*, the outward expanse in the horizontal plane direction at the center in the longitudinal direction is small and the outward expanse in the horizontal plane direction at the end portion in the longitudinal direction is large.

In this case, each parameter that defines the shape of the preformed part 11 formed at the first forming step is assumed to satisfy the following assumptions (i), (ii), and (iii) with reference to the target shape of the press-formed product 1 (see FIG. 1 and FIG. 2).

(i) A width w of the top portion 13 of the preformed part 11 is the same as the width of the top portion 3 of the press-formed product 1 of the target shape.

(ii) In the cross-section orthogonal to the longitudinal direction, a length L (cross-sectional length of the side wall portion 15) of the ridgeline from a punch-shoulder R portion 14 to a die-shoulder R portion 16 of the preformed part 11 is the same as the length (cross-sectional length of the side wall portion 5) of the ridgeline from a punch-shoulder R portion 4 to a die-shoulder R portion 6 of the press-formed product 1 of the target shape.

(iii) The angle γ that is formed by the side wall portion adjacent to flange 15*b* and the horizontal plane in the preformed part 11 is the same as the angle that is formed by the side wall portion 5 and the horizontal plane in the press-formed product 1 of the target shape.

The bent portion 15*c* in the side wall portion 15 for which the shape is defined under these assumptions (i) to (iii) is bent in the opposite direction (reverse bending) to the wall curl due to the conventional springback illustrated in FIG. 2. Thus, by forming the side wall portion 15 in the target shape at the second forming step, a spring-go component is imparted to the side wall portion 5.

Then, the angle φ that is formed by the side wall portion adjacent to top 15*a* in the preformed part 11 formed at the first forming step and the horizontal plane being small means that the bending of the side wall portion adjacent to top 15*a* and the side wall portion adjacent to flange 15*b* in the side wall portion 15 is to be large (see FIG. 1(*b*)). Thus, the spring-go component imparted to the side wall portion 5 in the process of forming the side wall portion 15 into the target shape at the second forming step increases as the angle φ of the side wall portion 15 is smaller, so that the wall curl of the side wall portion 5 is further suppressed. As a result, the angle change of the flange portion 7 can be reduced.

Moreover, the press forming method according to the first embodiment, as in the foregoing, sets the angle φ that is formed by the side wall portion adjacent to top 15*a* and the horizontal plane in the preformed part 11 so that, as compared with the angle $\varphi_c$ at the center in the longitudinal direction, the angle $\varphi_s$ at the end portion in the longitudinal direction is decreased, and the reasons are as follows.

Figure 5:
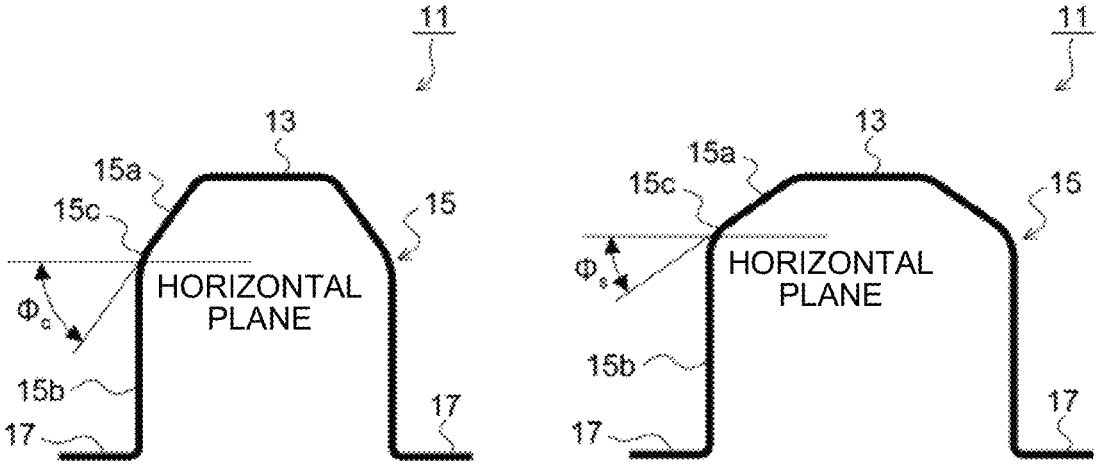
FIG. 5 is a cross-sectional view for explaining the suppression effect of springback due to the difference in the angle of the side wall portion of the preformed part in the press forming method according to the first embodiment of the present invention ((a) is a center in the longitudinal direction, (b) is an end portion in the longitudinal direction).

At the center in the longitudinal direction of the preformed part 11, the restraint by the material (stiffness due to the shape) on both sides in the longitudinal direction is strong, and thus, even if the same springback driving force (residual stress) is exerted, the amount of springback is small. Thus, as illustrated in FIG. 5(*a*), the angle $\varphi_c$ at the center in the longitudinal direction of the preformed part 11 is increased so as to reduce a springback suppression effect.

Meanwhile, at the end portion in the longitudinal direction of the preformed part 11, the restraint (stiffness due to the shape) is weak because there is no material on the outside in the longitudinal direction, and thus, even if the same springback driving force (residual stress) is exerted, the amount of springback that arises is large. Thus, as illustrated in FIG. 5(*b*), the angle $\varphi_s$ at the end portion in the longitudinal direction of the preformed part 11 is reduced as compared with the center in the longitudinal direction so as to increase the springback suppression effect.

As just described, in the press forming method according to the first embodiment, the angle φ formed by the side wall portion adjacent to top 15*a* of the preformed part 11 and the horizontal plane is decreased toward the end portion from the center in the longitudinal direction, so that the wall curl of the side wall portion 5 can be suppressed over the entire length in the longitudinal direction and the angle change of the flange portion 7 can be reduced.

When changing the angle φ, the height h from the top portion 13 to the bent portion 15*c* in the press-forming direction may be constant (FIG. 1(*b*), $h_c=h_s$) over the end portion from the center in the longitudinal direction or may be changed.

However, as illustrated in a second embodiment described later, in the preformed part 11, the height h from the top portion 13 to the bent portion 15*c* is increased toward the end portion from the center in the longitudinal direction, so that a synergistic effect of suppressing the wall curl of the side wall portion 5 by the angle φ and by the height h can be obtained, and the angle change of the flange portion 7 can be further reduced.

Second Embodiment

Figure 6:
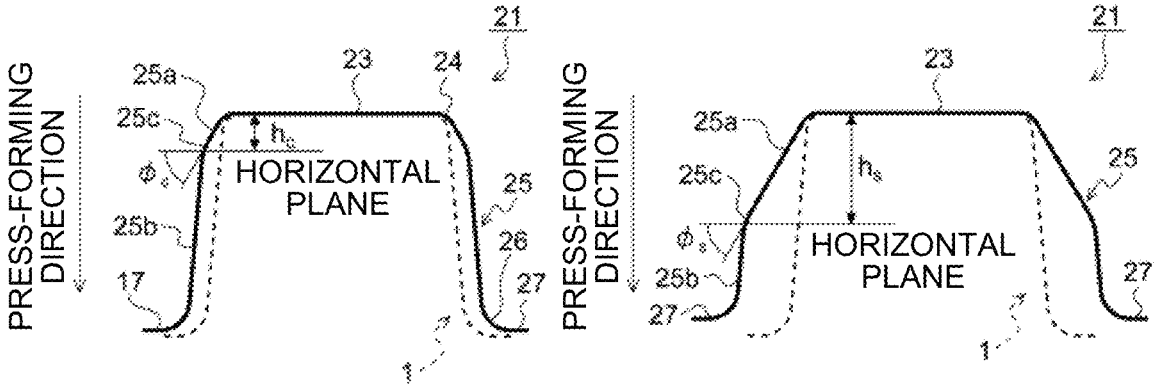
FIG. 6 is a cross-sectional view for explaining the preformed part in a press forming method according to a second embodiment of the present invention ((a) is a center in the longitudinal direction, (b) is an end portion in the longitudinal direction).

A press forming method according to a second embodiment of the present invention is the one in which the press-formed product 1 as illustrated in FIG. 1(*c*) as an example is press-formed and that includes a first forming step of press-forming a preformed part 21 having a cross-sectional shape as illustrated in FIG. 6 as an example and a second forming step of press-forming the preformed part 21 into the press-formed product 1 of the target shape.

<First Forming Step>

The first forming step is a step of press-forming the preformed part 21 having, as illustrated in FIG. 6, a top portion 23 and flange portions 27 of the same shape as the target shape of the press-formed product 1, and side wall portions 25 having an outwardly projecting chevron shape in a cross-section in the press-forming direction as compared with the target shape of the press-formed product 1.

Each of the side wall portions 25 has a side wall portion adjacent to top 25*a* connecting to the top portion 23, a side wall portion adjacent to flange 25*b* connecting to the flange portion 27, and a bent portion 25*c* between the side wall portion adjacent to top 25*a* and the side wall portion adjacent to flange 25*b*. In this case, the shape of the side wall portion 25 is, as with the preformed part 11 (see FIG. 3) in the foregoing first embodiment, defined by the height h from the top portion 23 to the bent portion 25*c* in the cross-section in the press-forming direction, the angle φ on the acute side formed by the side wall portion adjacent to top 25*a* and the horizontal plane, and the angle γ formed by the side wall portion adjacent to flange 25*b* and the horizontal plane.

Moreover, in the second embodiment, the preformed part 21 is set so that, as illustrated in FIG. 6, the height h from the top portion 23 to the bent portion 25*c* in the press-forming direction of the preformed part 21 is increased toward the end portion (height $h_s$) from the center (height $h_c$) in the longitudinal direction.

Herein, in the preformed part 21, the side wall portions 25 are each formed on the inner side and the outer side of the curve along the longitudinal direction in planar view. Then, on both the inner side of the curve and the outer side of the curve of the side wall portions 25, the height h from the top portion 23 to the bent portion 25*c* is set to increase toward the end portion from the center in the longitudinal direction.

Note that the angle γ that is formed by the side wall portion adjacent to flange 25*b* and the horizontal plane only needs to be set to the same angle as the angle that is formed by the side wall portion 5 of the target shape and the horizontal plane.

<Second Forming Step>

The second forming step is a step of press-forming the preformed part 21 that has been press-formed at the first forming step into the press-formed product 1 of the target shape. By the second forming step, the side wall portions 25 of the preformed part 21 are press-formed into the side wall portions 5 of the same shape as the target shape.

<Reasons of Improving Accuracy of Flange Angle by Changing Height h>

The reasons why it is possible to suppress the angle change (see FIG. 2) of the flange portion 7 of the press-formed product 1 due to springback by the press forming method according to the second embodiment will be described below.

As in the foregoing, in the bent portion 25*c* in the preformed part 21, the height $h_c$ at the center in the longitudinal direction is small (close to the top portion 23) and the height $h_s$ at the end portion in the longitudinal direction is large (away from the top portion 23).

In this case, each parameter (see FIG. 3) that defines the shape of the preformed part 21 formed at the first forming step is assumed to satisfy the following assumptions (i'), (ii'), and (iii') with reference to the target shape of the press-formed product 1.

(I') The width w of the top portion 23 of the preformed part 21 is the same as the width of the top portion 3 of the press-formed product 1 of the target shape.

(ii') In the cross-section orthogonal to the longitudinal direction, the length L (cross-sectional length of the side wall portion 15) of the ridgeline from a punch-shoulder R portion 24 to a die-shoulder R portion 26 of the preformed part 21 is the same as the length (cross-sectional length of the side wall portion 5) of the ridgeline from the punch-shoulder R portion 4 to the die-shoulder R portion 6 of the press-formed product 1 of the target shape.

(iii') The angle γ that is formed by the side wall portion adjacent to flange 25*b* and the horizontal plane in the preformed part 21 is the same as the angle that is formed by the side wall portion 5 and the horizontal plane in the press-formed product 1.

The bent portion 25*c* in the side wall portion 25 for which the shape is defined under these assumptions (i') to (iii') is bent in the direction opposite to the wall curl due to the conventional springback illustrated in FIG. 2. Thus, by forming the side wall portion 25 in the target shape at the second forming step, a spring-go component is imparted to the side wall portion 5.

In this case, the magnitude of the spring-go component depends on the bending of the side wall portion adjacent to top 25*a* and the side wall portion adjacent to flange 25*b* in the side wall portion 25, that is, the angle φ that is formed by the side wall portion adjacent to top 25*a* and the horizontal plane. Thus, even if the height h from the top portion 23 to the bent portion 25*c* is changed under the condition that the angle φ formed by the side wall portion adjacent to top 25*a* and the horizontal plane is the same, the magnitude of the spring-go component imparted to the side wall portion 5 at the second forming step is the same.

However, if the height h from the top portion 23 to the bent portion 25*c* in the preformed part 21 formed at the first forming step is large, the length of the side wall portion adjacent to flange 25*b* (height in the press-forming direction) is short. In addition, while the side wall portion adjacent to top 25*a* of the preformed part 21 has almost no wall curl, the wall curl is large in the side wall portion adjacent to flange 25*b*. Thus, at the second forming step, when the length of the side wall portion adjacent to flange 25*b* (height in the press-forming direction) is short, the springback due to the wall curl of the side wall portion 5 can be suppressed. As a result, the angle change of the flange portion 7 can be reduced.

As just described, based on the relation between the height from the top portion 3 to the bent portion 25*c* and the angle change of the flange portion 7 due to the springback, the press forming method according to the second embodiment, as in the foregoing, sets the height h from the top portion 3 to the bent portion 25*c* in the preformed part 21 so that, as compared with the height $h_c$ at the center in the longitudinal direction, the height $h_s$ at the end portion in the longitudinal direction is large, and the reasons are as follows.

At the center in the longitudinal direction of the preformed part 21, the restraint by the material (stiffness due to the shape) on both sides in the longitudinal direction is strong, and thus, even if the same springback driving force (residual stress) is exerted, the amount of springback is small. Thus, as illustrated in FIG. 7(*a*), even if the height $h_c$ from the top portion 23 to the bent portion 25*c* is reduced and the height $h_{bc}$ of the side wall portion adjacent to flange 25*b* is increased, the amount of the springback due to wall curl in the side wall portion adjacent to flange 25*b* remains small.

Figure 7:
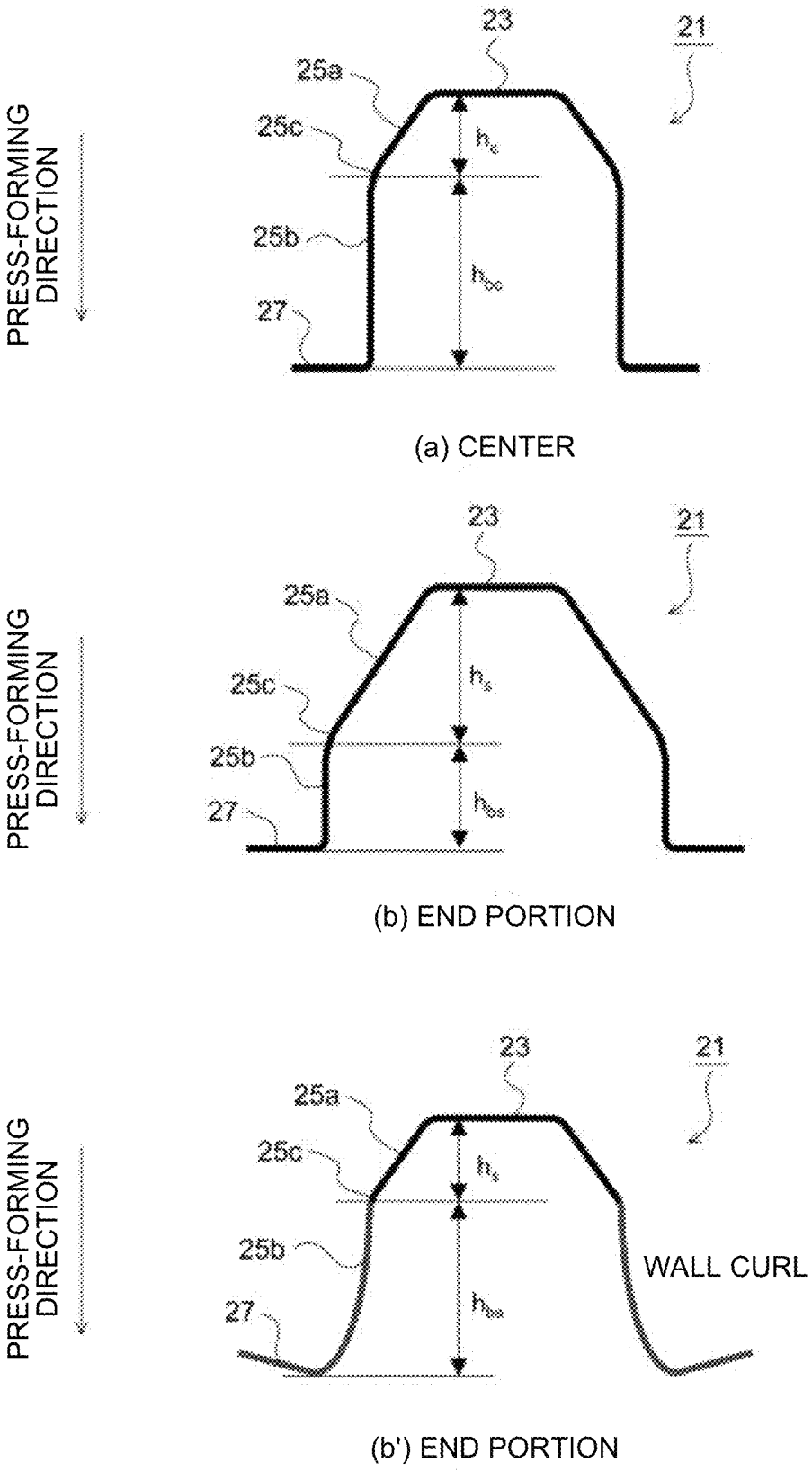
FIG. 7 is a diagram for explaining the suppression effect of springback due to the difference in the height of a bent portion of the preformed part in the press forming method according to the second embodiment of the present invention ((a) is a center in the longitudinal direction, (b) is an end portion in the longitudinal direction, (b') is a wall curl due to springback at the end portion in the longitudinal direction).

Meanwhile, at the end portion in the longitudinal direction of the preformed part 21, the restraint (stiffness due to the shape) is weak because there is no material on the outside in the longitudinal direction, and when the springback driving force (residual stress) of the same extent as that at the center in the longitudinal direction is exerted, the wall curl that is the amount of springback arises significantly (FIG. 7(*b*')). Thus, at the end portion in the longitudinal direction of the preformed part 21, as illustrated in FIG. 7(*b*), the height $h_s$ from the top portion 23 to the bent portion 25*c* is increased as compared with the center in the longitudinal direction, reducing the height $h_{bs}$ of the side wall portion adjacent to flange 25*b* and suppressing the amount of springback due to the wall curl in the side wall portion adjacent to flange 25*b*.

As just described, in the press forming method according to the second embodiment, the height h from the top portion 23 to the bent portion 25*c* of the preformed part 21 is increased toward the end portion from the center in the longitudinal direction, so that the wall curl of the side wall portion 5 can be suppressed over the entire length in the longitudinal direction and the angle change of the flange portion 7 can be reduced.

When changing the height h from the top portion 23 to the bent portion 25*c*, the angle φ that is formed by the side wall portion adjacent to top 25*a* and the horizontal plane may be constant (FIG. 6, $\varphi_c=\varphi_s$) over the end portion from the center in the longitudinal direction or may be changed.

However, as has been illustrated in the foregoing first embodiment, the angle φ that is formed by the side wall portion adjacent to top 25*a* and the horizontal plane is decreased toward the end portion from the center in the longitudinal direction, so that a synergistic effect of reducing the wall curl of the side wall portion 5 by the angle φ and by the height h can be obtained, and the angle change of the flange portion 7 can be further reduced.

EXAMPLES

Experiments to confirm the action and effect of the press forming method according to the present invention were conducted, and the results will be described below.

In the experiments, with the press-formed product 1 having a hat-shaped cross section curving along the longitudinal direction in planar view illustrated in FIG. 1(*c*) as a forming target, at the first forming step, a preformed part having side wall portions in an outwardly projecting chevron shape as compared with the side wall portion 5 of the target shape was press-formed, and at the subsequent second forming step, the relevant preformed part was press-formed into the press-formed product 1 of the target shape. Then, the angle change of the flange portion 7 after the die release of the press-formed product 1 that was press-formed to the bottom dead center of forming at the second forming step was obtained.

The dimensions of the target shape of the press-formed product 1 were set as follows: the curvature radius of the curve was 500 mm or 1000 mm, the width of the top portion 3 was 60 mm, the forming height was 60 mm, the angle formed by the side wall portion 5 and the horizontal plane was 85 degrees, the curvature radius of the punch-shoulder R portion 4 was 5 mm, and the curvature radius of the die-shoulder R portion 6 was 8 mm. The metal sheet used for the press-forming of the press-formed product 1 was a steel sheet having a thickness of 1.2 mm and in a tensile strength of 980 MPa class.

First Example, Influence of Angle φ Formed by Side Wall Portion Adjacent to Top and Horizontal Plane In the first example, at the first forming step, as illustrated in FIG. 1(*b*), the preformed part 11 for which the angle φ that is formed by the side wall portion adjacent to top 15*a* and the horizontal plane was set to decrease toward the end portion (cps) from the center ($\varphi_c$) in the longitudinal direction, while the height h from the top portion 13 to the bent portion 15*c* was constant ($h_c=h_s$) was press-formed. Then, at the subsequent second forming step, the preformed part 11 was press-formed into the press-formed product 1 of the target shape and the angle change of the flange portion 7 due to the springback of the press-formed product 1 with reference to the joint surface (horizontal plane) of the flange portion 7 of the target shape was obtained.

In this case, in the preformed part 11, the angle φ that is formed by the side wall portion adjacent to top 15*a* and the horizontal plane was set so that, as indicated in Table 1 and Table 2, on both the inner side of the curve and the outer side of the curve of the preformed part 11 that curves along the longitudinal direction, an angle $\varphi_{is}$ (inner side of the curve) and an angle $\varphi_{os}$ (outer side of the curve) at the end portion (location of 170 mm from the center) in the longitudinal direction are to be small ($\varphi_{is}<\varphi_{ic}$, $\varphi_{os}<\varphi_{oc}$) as compared with an angle $\varphi_{ic}$ (inner side of the curve) and an angle $\varphi_{oc}$ (outer side of the curve), respectively, at the center in the longitudinal direction.

TABLE 1

| Curvature radius of curve 500 mm | Conventional example (°) | Comparative example (°) | Example (°) |
|---|---|---|---|
| $\varphi_{ic}$ (Inner side of curve, center in longitudinal direction) | — | 80 | 70 |
| $\varphi_{is}$ (Inner side of curve, end portion in longitudinal direction) | — | 80 | 45 |

TABLE 1-continued

| Curvature radius of curve 500 mm | Conventional example (°) | Comparative example (°) | Example (°) |
|---|---|---|---|
| $\varphi_{oc}$ (Outer side of curve, center in longitudinal direction) | — | 80 | 55 |
| $\varphi_{os}$ (Outer side of curve, end portion in longitudinal direction) | — | 80 | 50 |
| Angle change of flange portion ($^0$) | 9.0 | 7.7 | 2.4 |

TABLE 2

| Curvature radius of curve 1000 mm | Conventional example (°) | Comparative example (°) | Example (°) |
|---|---|---|---|
| $\varphi_{ic}$ (Inner side of curve, center in longitudinal direction) | — | 80 | 70 |
| $\varphi_{is}$ (Inner side of curve, end portion in longitudinal direction) | — | 80 | 50 |
| $\varphi_{oc}$ (Outer side of curve, center in longitudinal direction) | — | 80 | 60 |
| $\varphi_{os}$ (Outer side of curve, end portion in longitudinal direction) | — | 80 | 55 |
| Angle change of flange portion (°) | 15.7 | 11.0 | 1.4 |

The height h from the top portion 13 to the bent portion 15*c* in the preformed part 11 was to be 30 mm and the curvature radius R of the bent portion 15*c* was to be 15 mm. The width of the top portion 13 and the width of the flange portion 17 of the preformed part 11 were to be the same as those of the press-formed product 1 of the target shape. Moreover, the length (cross-sectional length of the side wall portion 15) of the ridgeline from the punch-shoulder R portion 14 to the die-shoulder R portion 16 of the preformed part 11 and the angle of the side wall portion adjacent to flange 15*b* with respect to the horizontal plane were to be the same as the length (cross-sectional length of the side wall portion 5) of the ridgeline from the punch-shoulder R portion 4 to the die-shoulder R portion 6 of the press-formed product 1 and the angle of the side wall portion 5 with respect to the horizontal plane, respectively.

The angle change of the flange portion 7 after the die release of the press-formed product 1 was evaluated (see FIG. 2) by the flange angle θ with reference to the joint surface (horizontal plane) of the flange portion 7 of the target shape.

Note that as comparison targets, a press-formed product 1 of the target shape that has been press-formed in one step was used as a conventional example, a press-formed product 1 of the target shape that has been press-formed in two steps of the first forming step of press-forming the preformed part 11 having the side wall portions 15 for which both the angle φ by the side wall portion adjacent to top 15*a* and the horizontal plane and the height h of the bent portion 15*c* are constant in the longitudinal direction and of the second forming step of press-forming the preformed part 11 was used as a comparative example, and the angle change of the flange portion 7 due to the springback was evaluated for each.

Figure 8:
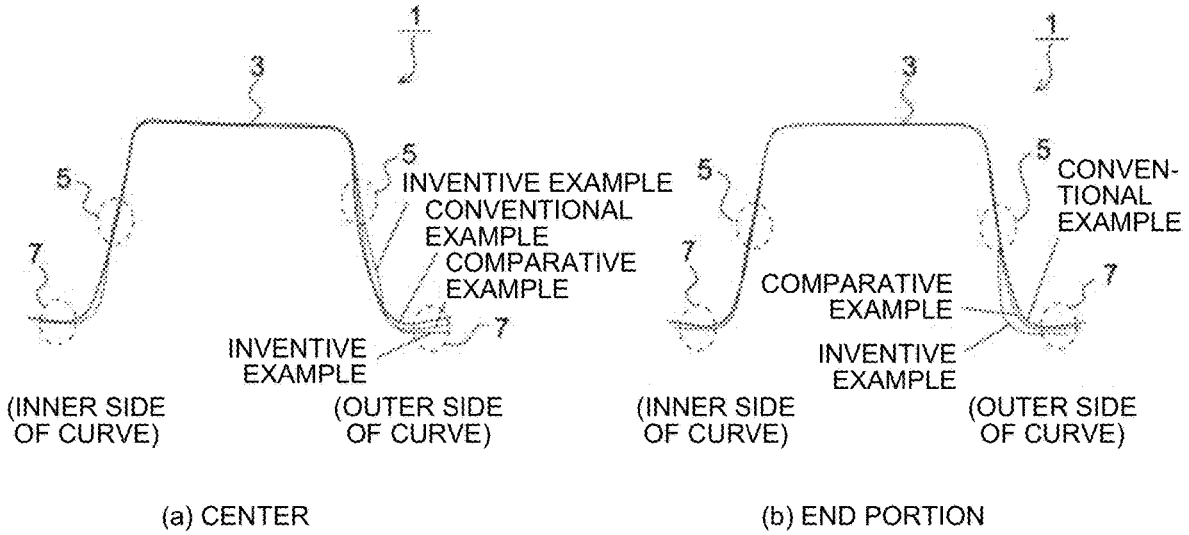
FIG. 8 is a diagram illustrating a result of the cross-sectional shape of the press-formed product after springback in an example (part 1).
Figure 9:
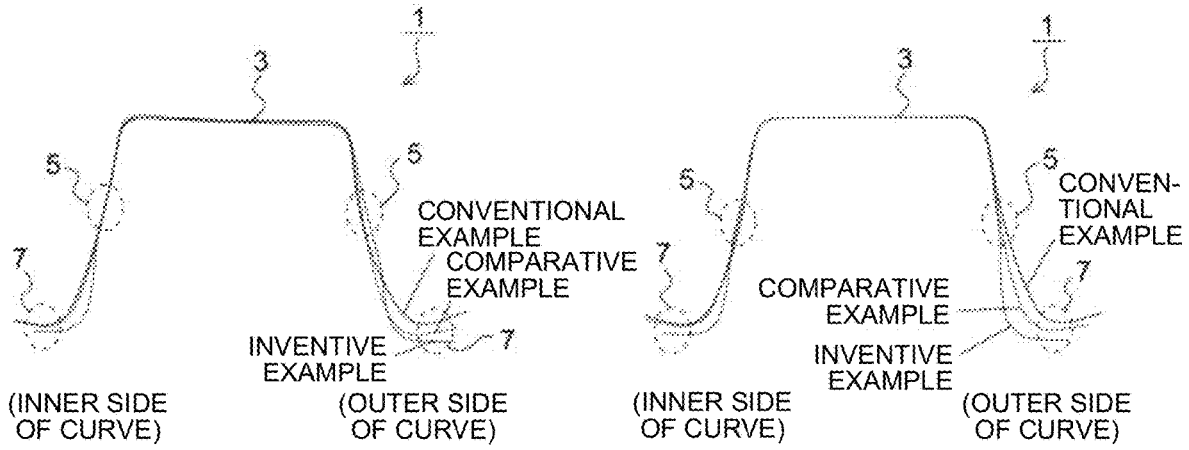
FIG. 9 is a diagram illustrating the result of the cross-sectional shape of the press-formed product after springback in the example (part 2).

FIG. 8 and FIG. 9 illustrate cross-sectional shapes after springback of the press-formed products 1 for which the curvature radii of the curves are 500 mm and 1000 mm, respectively. From FIG. 8 and FIG. 9, in both curvature radii of the curves, in the comparative example and the inventive example that were press-formed into the press-formed product 1 of the target shape in two steps, as compared with the conventional example, the wall curl of the side wall portion 5 has been suppressed. In addition, comparing the comparative example and the inventive example, it can be found that the wall curl of the side wall portion 5 has been further suppressed in the inventive example.

In the above-mentioned Table 1 and Table 2, the results of the angle change of the flange portion 7 after die release of the press-formed product 1 are indicated. In this case, the angle changes of the flange portion indicated in Table 1 and Table 2 are the average of each of the angle changes of the flange portion 7 at the inner side of the curve and the outer side of the curve, and at the center and the end portion in the longitudinal direction.

From Table 1 and Table 2, as compared with the conventional example for which the press-formed product 1 is press-formed in one step, in the comparative example and the inventive example of press-forming in two steps, it can be found that the angle change of the flange portion 7 has been reduced. In addition, comparing the comparative example and the inventive example, for each of the side wall portions 15 on the inner side of the curve and the outer side of the curve, on the inventive example for which the angle φ formed by the side wall portion adjacent to top 15*a* and the horizontal plane was set small at the end portion as compared with the center in the longitudinal direction, the angle change of the flange portion was significantly reduced, resulting in favorable results.

Second Example, Influence of Height h of Bent Portion

In the second example, at the first forming step, as illustrated in FIG. 6, the preformed part 21 for which the height h from the top portion 23 to the bent portion 25*c* was set to increase toward the end portion ($h_s$) from the center ($h_c$) in the longitudinal direction, while the angle φ formed by the side wall portion adjacent to top 25*a* and the horizontal plane was constant ($\varphi_c=\varphi_s$) was press-formed. Then, at the subsequent second forming step, the preformed part 21 was press-formed into the press-formed product 1 of the target shape and the angle change of the flange portion 7 due to the springback of the press-formed product 1 with reference to the joint surface (horizontal plane) of the flange portion 7 of the target shape was obtained.

In this case, in the preformed part 21, the height h from the top portion 23 to the bent portion 25*c* was set so that, as indicated in Table 3 and Table 4, on both the inner side of the curve and the outer side of the curve of the preformed part 21 that curves along the longitudinal direction, a height $h_{is}$ (inner side of the curve) and a height $h_{os}$ (outer side of the curve) at the end portion (location of 170 mm from the center) in the longitudinal direction are to be large ($h_{is}>h_{ic}$, $h_{os}>h_{oc}$) as compared with a height $h_{ic}$ (inner side of the curve) and a height $h_{oc}$ (outer side of the curve), respectively, at the center in the longitudinal direction.

TABLE 3

| Curvature radius of curve 500 mm | Conventional example (mm) | Comparative example (mm) | Example (mm) |
|---|---|---|---|
| $h_{ic}$ (Inner side of curve, center in longitudinal direction) | — | 10 | 10 |
| $h_{is}$ (Inner side of curve, end portion in longitudinal direction) | — | 10 | 30 |
| $h_{oc}$ (Outer side of curve, center in longitudinal direction) | — | 10 | 20 |
| $h_{os}$ (Outer side of curve, end portion in longitudinal direction) | — | 10 | 40 |
| Angle change of flange portion (°) | 9.0 | 6.8 | 3.4 |

TABLE 4

| Curvature radius of curve 1000 mm | Conventional example (mm) | Comparative example (mm) | Example (mm) |
|---|---|---|---|
| $h_{ic}$ (Inner side of curve, center in longitudinal direction) | — | 40 | 25 |
| $h_{is}$ (Inner side of curve, end portion in longitudinal direction) | — | 40 | 40 |
| $h_{oc}$ (Outer side of curve, center in longitudinal direction) | — | 40 | 35 |
| $h_{os}$ (Outer side of curve, end portion in longitudinal direction) | — | 40 | 40 |
| Angle change of flange portion (°) | 15.7 | 2.1 | 1.3 |

The angle φ formed by the side wall portion adjacent to top 25*a* in the preformed part 21 and the horizontal plane was to be 60°, and a curvature radius R of the bent portion 25*c* was to be 15 mm. The width of the top portion 23 and the width of the flange portion 27 of the preformed part 21 are to be the same as those of the press-formed product 1 of the target shape. Moreover, the length (cross-sectional length of the side wall portion 25) of the ridgeline from the punch-shoulder R portion 24 to the die-shoulder R portion 26 of the preformed part 21 and the angle of the side wall portion adjacent to flange 25*b* with respect to the horizontal plane were to be the same as the length (cross-sectional length of the side wall portion 5) of the ridgeline from the punch-shoulder R portion 4 to the die-shoulder R portion 6 of the press-formed product 1 and the angle of the side wall portion 5 with respect to the horizontal plane, respectively.

The angle change of the flange portion 7 after the die release of the press-formed product 1 was, as with the above-described first embodiment, evaluated (see FIG. 2) by the flange portion angle θ with reference to the joint surface (horizontal plane) of the flange portion of the target shape.

As with the first example, as the comparison targets, a press-formed product 1 of the target shape that has been press-formed in one step was used as a conventional example, a press-formed product 1 of the target shape that has been press-formed in two steps of the first forming step of press-forming the preformed part 21 having the side wall portions 25 for which both the angle φ by the side wall portion adjacent to top 25*a* and the horizontal plane and the height h from the top portion 23 to the bent portion 25*c* are constant in the longitudinal direction and of the second forming step of press-forming the preformed part 21 was used as a comparative example, and the angle change of the flange portion 7 was evaluated for each.

Figure 10:
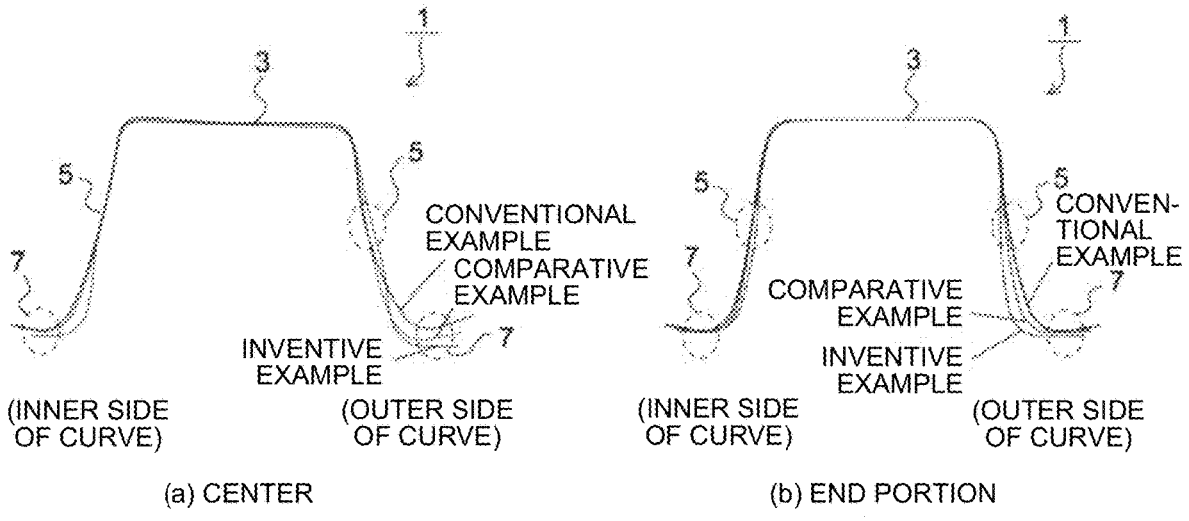
FIG. 10 is a diagram illustrating the result of the cross-sectional shape of the press-formed product after springback in the example (part 3).
Figure 11:
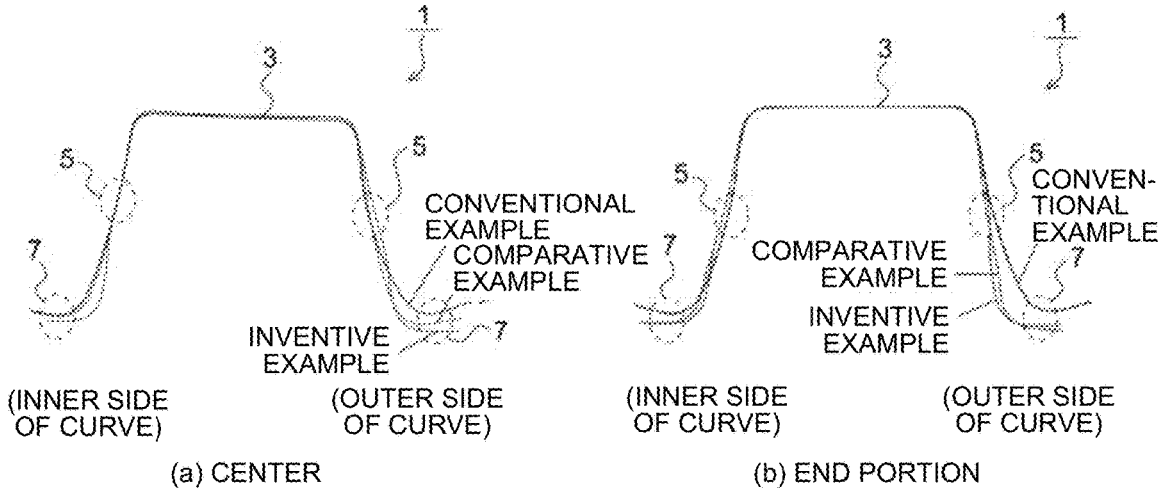
FIG. 11 is a diagram illustrating the result of the cross-sectional shape of the press-formed product after springback in the example (part 4).

FIG. 10 and FIG. 11 illustrate cross-sectional shapes after springback of the press-formed products 1 for which the curvature radii of the curves are 500 mm and 1000 mm, respectively. From FIG. 10 and FIG. 11, in both curvature radii of the curves, in the comparative example and the inventive example that were press-formed into the press-formed product 1 of the target shape in two steps, as compared with the conventional example, the wall curl of the side wall portion 5 has been suppressed. In addition, comparing the comparative example and the inventive example, it can be found that the wall curl of the side wall portion 5 has been further suppressed in the inventive example.

In the above-mentioned Table 3 and Table 4, the results of the angle change of the flange portion 7 after die release of the press-formed product 1 are indicated. In this case, the angle changes of the flange portion indicated in Table 3 and Table 4 are the average of each of the angle changes of the flange portion 7 at the center and the end portion in the longitudinal direction on the inner side of the curve and at the center and the end portion in the longitudinal direction on the outer side of the curve.

From Table 3 and Table 4, as compared with the conventional example for which the press-formed product 1 is press-formed in one step, in the comparative example and the inventive example of press-forming in two steps, it can be found that the angle change of the flange portion 7 has been reduced. In addition, comparing the comparative example and the inventive example, for each of the side wall portions 25 on the inner side of the curve and the outer side of the curve, on the inventive example for which the height h of the bent portion 25*c* was set to be large at the end portion as compared with the center in the longitudinal direction, the angle change of the flange portion was significantly reduced, resulting in favorable results.

As in the foregoing, according to the present invention, it has been demonstrated that, when press-forming a press-formed product having a hat-shaped cross section curving along the longitudinal direction in planar view, the angle change of the flange portion due to the springback can be suppressed.

INDUSTRIAL APPLICABILITY

According to the present invention, a press forming method for which, when press-forming a press-formed product having a hat-shaped cross section curving along the longitudinal direction in planar view, the accuracy of the angle of the flange portion was improved on both the center and the end portion side in the longitudinal direction can be provided.

REFERENCE SIGNS LIST

1 PRESS-FORMED PRODUCT
3 TOP PORTION
4 PUNCH-SHOULDER R PORTION
5 SIDE WALL PORTION

6 DIE-SHOULDER R PORTION
7 FLANGE PORTION
11 PREFORMED PART
13 WEB
14 PUNCH-SHOULDER R PORTION
15 SIDE WALL PORTION
15*a* SIDE WALL PORTION ADJACENT TO TOP
15*b* SIDE WALL PORTION ADJACENT TO FLANGE
15*c* BENT PORTION
16 DIE-SHOULDER R PORTION
17 FLANGE PORTION
21 PREFORMED PART
23 WEB
24 PUNCH-SHOULDER R PORTION
25 SIDE WALL PORTION
25*a* SIDE WALL PORTION ADJACENT TO TOP
25*b* SIDE WALL PORTION ADJACENT TO FLANGE
25*c* BENT PORTION
26 DIE-SHOULDER R PORTION
27 FLANGE PORTION
101 PRESS FORMING TOOL
111 DIE
113 TOOL PORTION WHICH FORMS TOP
115 TOOL PORTION WHICH FORMS SIDE WALL
115*a* TOOL PORTION WHICH FORMS SIDE WALL ADJACENT TO TOP
115*b* TOOL PORTION WHICH FORMS SIDE WALL ADJACENT TO FLANGE
115*c* TOOL PORTION WHICH FORMS BEND
117 TOOL PORTION WHICH FORMS FLANGE
121 PUNCH
123 TOOL PORTION WHICH FORMS TOP
125 TOOL PORTION WHICH FORMS SIDE WALL
125*a* TOOL PORTION WHICH FORMS SIDE WALL ADJACENT TO TOP
125*b* TOOL PORTION WHICH FORMS SIDE WALL ADJACENT TO FLANGE
125*c* TOOL PORTION WHICH FORMS BEND
127 TOOL PORTION WHICH FORMS FLANGE

The invention claimed is:

1. A press forming method for press-forming a press-formed product having a hat-shaped cross section and including: a top portion; side wall portions continuous from the top portion; and flange portions continuous from the side wall portions, the press-formed product curving convexly outward from one of the side wall portions along a longitudinal direction of the press-formed product and curving perpendicular to a press-forming direction of the press-formed product which is perpendicular to a top portion side and parallel with the side wall portions, the press forming method comprising:

a first forming step of press-forming a preformed part including: a top portion and flange portions having same shapes as the top portion and the flange portions in a target shape of the press-formed product; and side wall portions having an outwardly projecting chevron shape in a cross-section in the press-forming direction, each of the preformed part side wall portions including: a portion adjacent to top connecting to the preformed part top portion; a portion adjacent to flange connecting to one of the preformed part flange portions; and a bent portion connected to the portion adjacent to the top and the portion adjacent to the flange, the bent portion projecting outwardly, and an angle on an acute side formed by the side wall portion adjacent to the top and a horizontal plane in the cross-section in the press-forming direction perpendicular to the longitudinal direction is set so as to decrease toward an end portion from a center in the longitudinal direction; and a second forming step of press-forming the preformed part into the press-formed product of the target shape while the side wall portions of the preformed part are press-formed into the side wall portions of a same shape as the target shape.

2. A press forming method for press-forming a press-formed product having a hat-shaped cross section and including: a top portion; side wall portions continuous from the top portion; and flange portions continuous from the side wall portions, the press-formed product curving, convexly outward from one of the side wall portions, along a longitudinal direction of the press-formed product and curving perpendicular to a press-forming direction of the press-formed product which is perpendicular to a top portion side and parallel with the side wall portions, the press forming method comprising:

a first forming step of press-forming a preformed part including: a top portion and flange portions having same shapes as the top portion and the flange portions in a target shape of the press-formed product; and side wall portions having an outwardly projecting chevron shape in a cross-section in the press-forming direction each of the preformed part side wall portions including: a portion adjacent to top connecting to the preformed part top portion; a portion adjacent to flange connecting to one of the preformed part flange portions; and a bent portion connected to the portion adjacent to the top and the portion adjacent to the flange, the bent portion projecting outwardly, and a height from the preformed part top portion to the bent portion in the press-forming direction in the cross-section in the press-forming direction perpendicular to the longitudinal direction is set so as to increase toward an end portion from a center in the longitudinal direction; and a second forming step of press-forming the preformed part into the press-formed product of the target shape while the side wall portions of the preformed part are press-formed into the side wall portions of a same shape as the target shape.

* * * * *